US006899328B2

(12) United States Patent
Halliburton et al.

(10) Patent No.: US 6,899,328 B2
(45) Date of Patent: May 31, 2005

(54) AMUSEMENT GAME

(75) Inventors: Ronald D. Halliburton, Delray Bch., FL (US); Steve Corso, Lake Worth, FL (US)

(73) Assignee: Benchmark Entertainment, L.C., Hypoluxo, FL (US)

( * ) Notice: Subject to any disclaimer, the term of this patent is extended or adjusted under 35 U.S.C. 154(b) by 242 days.

(21) Appl. No.: 10/152,571

(22) Filed: May 23, 2002

(65) Prior Publication Data

US 2002/0175465 A1 Nov. 28, 2002

Related U.S. Application Data

(60) Provisional application No. 60/292,530, filed on May 23, 2001, and provisional application No. 60/331,259, filed on Nov. 13, 2001.

(51) Int. Cl.[7] ..... A63F 1/00

(52) U.S. Cl. ..... 273/138.1; 273/138.3; 273/445

(58) Field of Search ..... 273/138.1, 138.2, 273/126 R, 355, 440, 138.3, 138.4, 142 R

(56) References Cited

U.S. PATENT DOCUMENTS 567,217 A * 9/1896 Kelly et al. ..... 248/112
4,061,334 A 12/1977 Kanno
4,662,636 A 5/1987 Crompton
5,297,816 A * 3/1994 Becchio ..... 273/459
5,385,347 A * 1/1995 Halliburton ..... 273/142 R
5,553,865 A 9/1996 Shoemaker, Jr.
5,622,366 A * 4/1997 Inoue ..... 273/138.2
5,707,060 A * 1/1998 Ogane et al. ..... 273/138.2
5,967,515 A * 10/1999 Halliburton ..... 273/138.2
6,092,807 A * 7/2000 Yu ..... 273/144 R
6,206,370 B1 * 3/2001 Halliburton ..... 273/138.1
6,254,479 B1 7/2001 Okitani
6,629,887 B1 * 10/2003 Todaiji et al. ..... 463/2

* cited by examiner

*Primary Examiner*—Derris H. Banks
*Assistant Examiner*—Alex F. R. P. Rada, II
(74) *Attorney, Agent, or Firm*—Venable LLP; Andrew C. Aitken

(57) ABSTRACT

An amusement game that includes a horizontally-oriented rotating wheel, a coin chute to introduce a coin to a central region of said rotating wheel wherein the coin slides on its lateral side, a stationary guide to direct the coin in a radial direction from the central region of the wheel toward the periphery of the wheel, and a plurality of payoff positions located at angular positions on the wheel. A detector is provided to determine if a coin introduced to the wheel intersects with a payoff position.

26 Claims, 8 Drawing Sheets

AMUSEMENT GAME

The present invention relates generally to an amusement game that can be adapted to make an award to a player based upon the skill of a player or can be configured to make a random award based entirely upon chance. The applicant claims the benefit of the filing date of U.S. Application Ser. No. 60/292,530 filed on May 23, 2001 and U.S. Application Ser. No. 60/331,259 that was filed on Nov. 13, 2001.

BACKGROUND OF THE INVENTION

In the amusement game industry and in the gaming industry, there is a constant demand for new products in order to attract the attention of players. One subset of the amusement game industry, referred to as redemption, provides players an award in the form of redeemable tickets in response to the skillful execution of a game. Tickets distributed from the game can be subsequently redeemed for prizes. Fast coin games, sometimes also referred to as token action games, use the coin itself as the game piece. Another subset of amusement games are referred to as "pusher games" where a player attempts to introduce a coin on a surface at a location where it is engaged by a pusher device so that it will contact adjacent coins and cause coins to fall off a ledge. The gaming industry is a further segment of the amusement industry and also demands a constant supply of new and innovative products to maintain the interest of players. In the gaming industry, the award to players is primarily based upon chance or luck rather than the skill of the player.

In the design of both amusement games and games used in the gaming industry, it is also desirable to provide an interesting game concept that can be quickly understood by a potential player. Yet a further advantageous characteristic of a game is to provide a design that is relatively simple and that is easy and inexpensive to manufacture. It is also beneficial to provide game designs that can be easily adapted to alternative commercial embodiments.

SUMMARY OF THE INVENTION

The present invention generally is directed to a game wherein a coin is released from a coin mechanism at a pre-selected time and is then introduced to a rotating wheel. The coin moves with the rotation of the wheel until it engages with the stationary coin guide that is positioned just above the surface of the wheel. When the coin engages the coin guide rotational movement of the coin is stopped and the coin begins to roll outwardly along the edge of the coin guide toward target positions located at angular locations on the wheel. Coins that are released from the coin guide to successfully intersect or overlap a target position are detected by a coin detector and a reward is provided to the player.

DETAILED DESCRIPTION OF THE INVENTION

Figure 1:
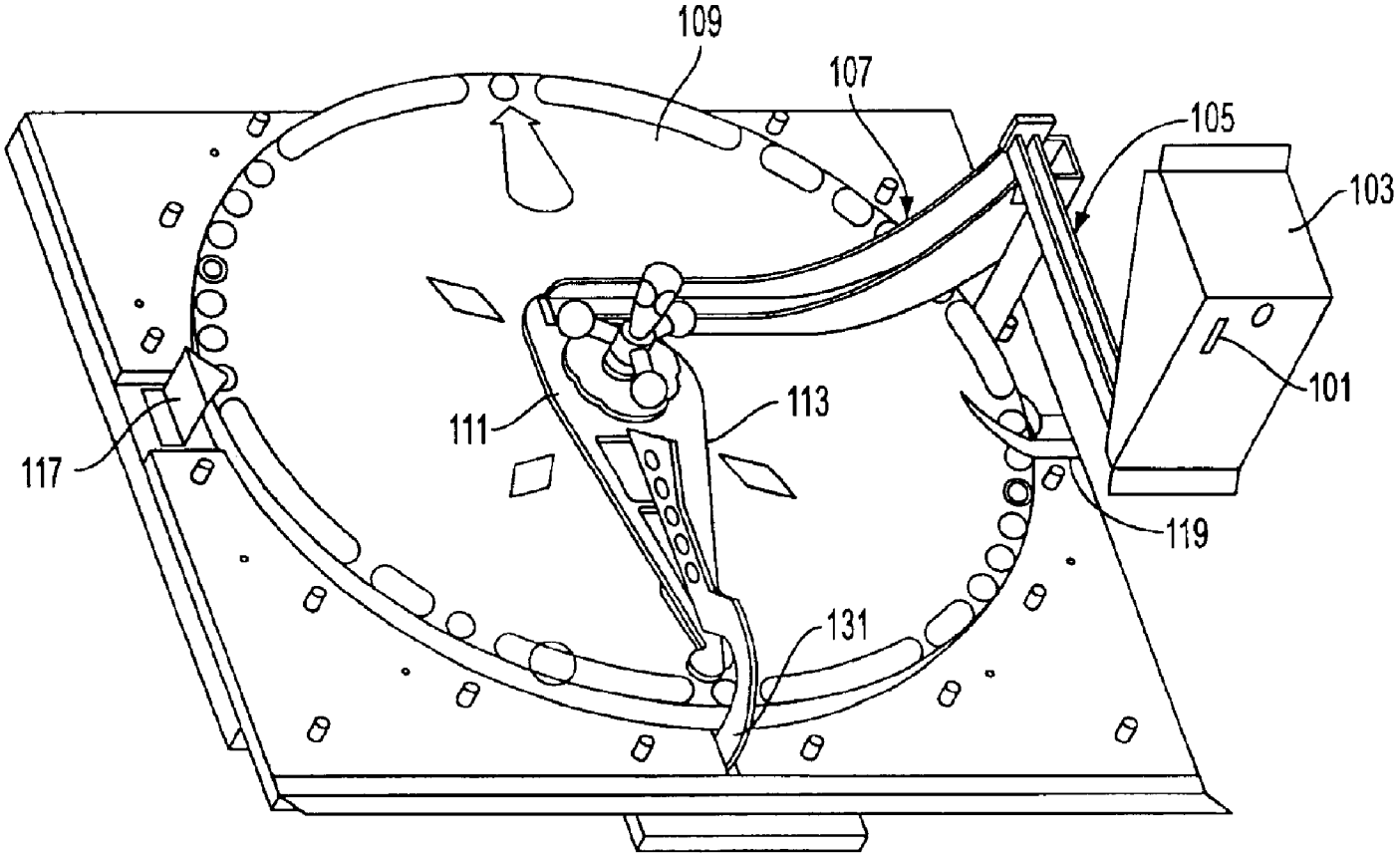
FIG. 1 is a perspective view of a first embodiment of the invention.
Figure 2:
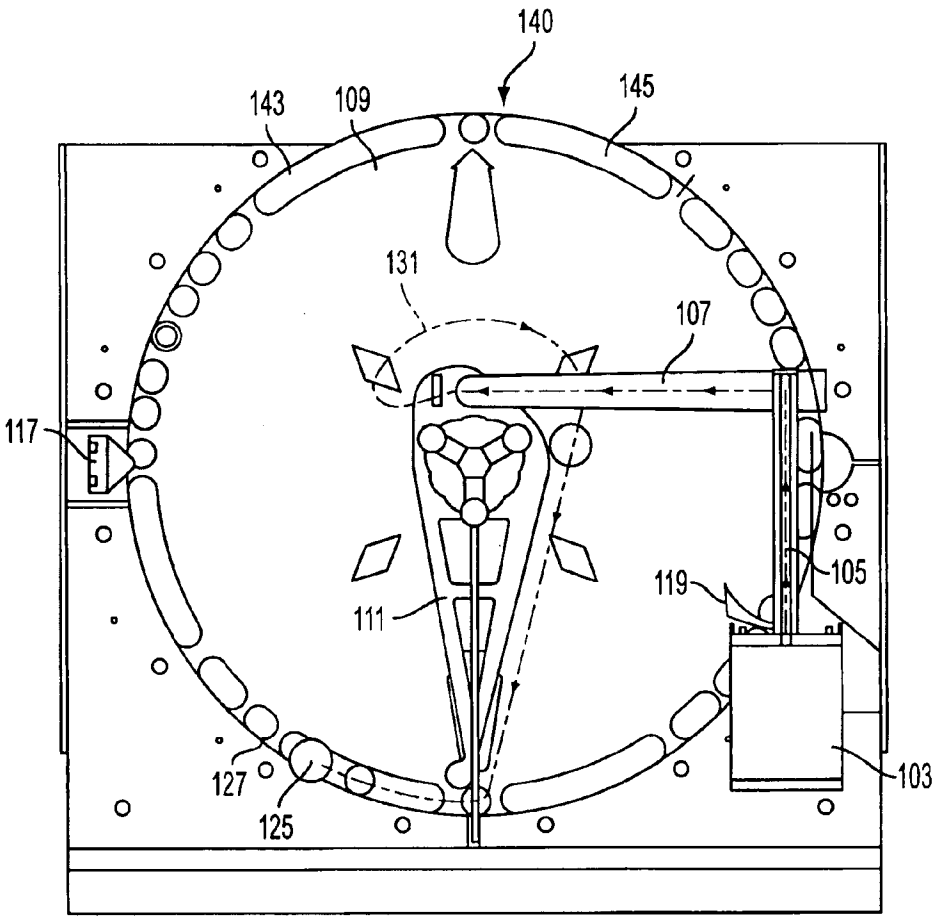
FIG. 2 is a top view of a first embodiment of the invention.

Now referring to FIG. 1, in a first embodiment of the invention, a coin may be inserted into slot 101 of coin acceptor 103 and directed to a first coin track 105 that has a U-shaped profile that allows a coin to roll in the track. In a preferred embodiment, a slot 101 or series of slots are provided for the reception of the coins or tokens into the coin mechanism 103. Coins that are inserted into a slot are directed to a coin acceptor. Coin mechanisms that accept genuine coins or tokens and reject those coins or tokens that are spurious are commercially available and well known in the art. The coin mechanism also serves as a dampening mechanism that ensures coins leaving the coin mechanism will leave at a fairly constant and predictable speed and pass through the coin mechanism itself at a fairly constant rate. If the coin is genuine, it is next directed to the inclined stationary track 105 where they roll toward a second stationary chute 107. A coin is directed from the first coin track 105 to chute 107 that changes the direction of travel of the coin and allows the coin to slide on its side toward the rotating wheel 109. Wheel 109 is oriented on a horizontal plane is driven at a constant speed of rotation around central axis 103. The wheel, which is preferably made of plywood, or plexiglass, is provided with a series of targets at angular positions near the periphery of the wheel. In this embodiment the wheel rotates relatively slowly, preferably at a rate of approximately 18 r.p.m. Coin chute 107 also has a "U-shaped profile, however the sidewalls are shorter than the sidewalls of the coin track and the floor of the chute is wider than the floor of the coin track 105. The width and height of the coin track enables the coin to roll in an upright position. The width of the coin chute allows the coin to slide on its planar side. The exit edge of coin chute 109 is shown resting on coin guide 111. The word "coin" is used herein to mean a monetary coin such as a quarter or it may also mean a token. In the first embodiment coin track 105 and coin chute 107 direct the coin at a predictable and repeatable rate towards wheel 109. Wheel 109 is also moved by a stepper motor at a relatively constant and predictable speed. A coin introduced to the wheel travels around the wheel in an arc until it reaches coin guide 111 that is positioned directly above the wheel. Coin guide 111 is positioned parallel with and just above the surface of wheel 109 so that the side walls or edges of any coins on the wheel will contact and be engaged by leading edge 113 of the coin guide. Support member 131 helps maintains the coin guide in position. The leading edge 113 of coin guide directs a coin radially outward from the center of wheel 109. The coins will appear to roll along the leading edge 113 of the coin guide and the movement of the wheel forces the coins in an outward direction and causes the coins to turn. A player records a win and receives a reward if he or she times the insertion of a coin into the track to cause the coin to eventually come to rest on a target or payoff position. As best seen in FIG. 2, the coin guide 111 is positioned to release a coin 125 so that an edge of the coin hangs over the edge 127 of the wheel 109 and is free of the guide 111. Coin 125 is shown after it has been released from the coin guide and has moved with the wheel in a clockwise direction. The path of the coin as it travels through the coin track 105, the coin chute 107 and on the wheel 109, is depicted by dotted line 131. As coin 125 travels with the wheel, it passes coin detector 117. Coin detector 117 comprises a light source and photodetector that is positioned right at the edge of the wheel and detects the presence of any object that hangs over the edge of the wheel. In this regard, if the beam of light impinging on the photodetector is interrupted by the coin, it will fail to generate a signal and this interruption is read by the central processing unit ("CPU") or controller. Not shown is a wheel position detector that tracks a home position location of the wheel. A coin will continue to travel along the periphery of the wheel until it is removed by knockoff arm 119. Coins removed from the wheel by knockoff arm 119 are directed to a coin receptacle. The entire game is encased in a cabinet that prevents the player from interfering with the travel of the coin.

Still referring to FIG. 2, the object of the first embodiment of the invention is to introduce a coin into the coin mechanism 103 so that it will eventually be released from the coin guide 111 at one of the selected payoff position or targets. As described above, the path of the coin as it travels down the coin track 105, drops into coin chute 107, slides on the wheel 109, travels around the wheel until it engages leading edge 113 of coin guide 111 and then rolls towards the outer periphery of the wheel. The location where the coin is released from the coin guide dictates whether or not the player has won. The targets on the wheel are graphically represented and, in the embodiment shown, the grand prize is at location 140. If a player misses the grand prize by causing the coin to rest on adjacent areas 143 or 145, no award is provided. A player that attempts to time the insertion of the coin so that it may land on target 140 will accordingly be provided a greater awarded if he or she is successful. However the risk of being provided no award is also greater because of the significant regions both before and after locations adjacent to the target that do not correspond with an award.

Figure 3:
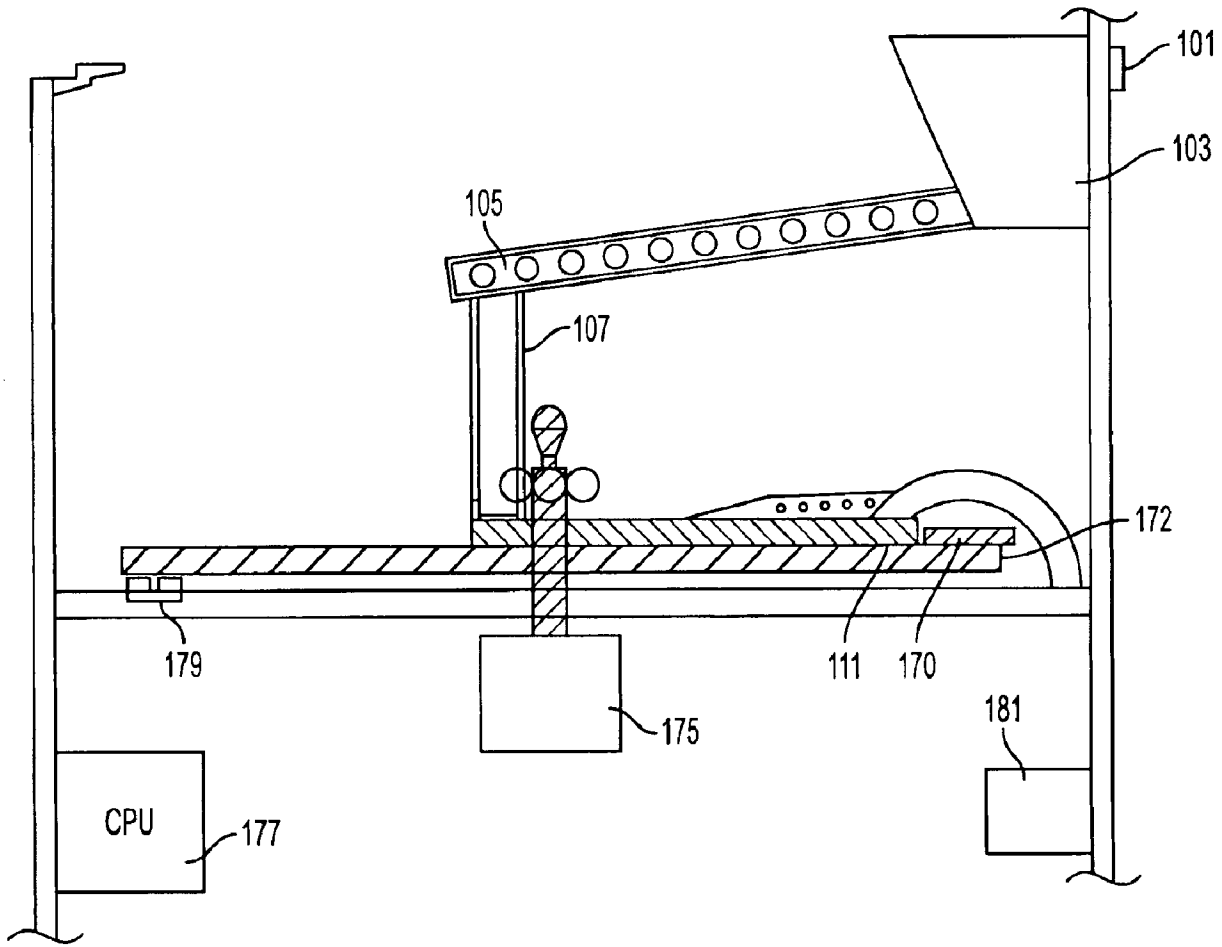
FIG. 3 is a side view of the first embodiment of the invention.

FIG. 3 depicts a sectional side view of the invention with a portion of the device shown in schematic. As seen in FIG. 3, the coin track 105 is inclined at an angle that allows coins to roll down the incline to coin chute 107. A coin 170 is depicted as it is released from coin guide 111 and has a portion extending over the edge 172 of wheel 109. Wheel 109 is driven by a stepper motor 175 that enables the CPU 177 to maintain information relating to the precise location of the wheel. A home position sensor 179 is schematically depicted that provides a signal to the CPU each time the wheel completes a revolution. Home position sensor 179 ensures that the CPU continues to accurately maintain information with respect to the position of the wheel. Ticket dispenser 181 is controlled by the CPU and is instructed to distribute tickets in response to the successful play.

Figure 4:
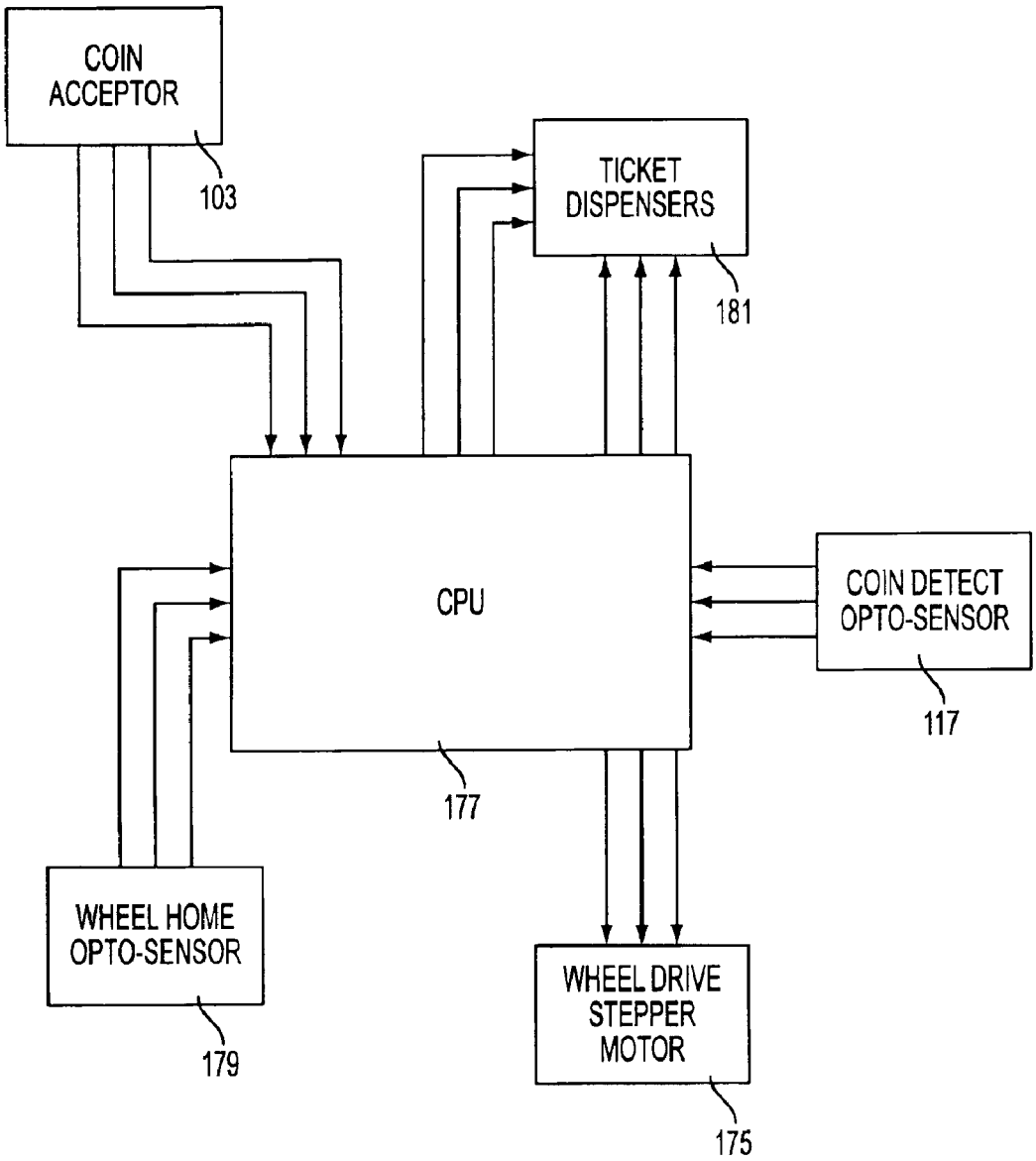
FIG. 4 is a schematic view of the control elements of the invention.

Now referring to FIG. 4, the game is controlled by central controller 177 or the CPU that receives input from coin acceptor 103, the coin detector 117 and the home position sensor 179. The controller provides output to the ticket dispenser and controls the stepper motor for the wheel. The controller may also control other game electronics such as the sound and light display that may be activated upon the successful play of the game. When a coin is detected by detector 117, the controller 175 looks up the position of the wheel that corresponds with the location of the coin that has been detected.

In the event the controller correlates the position of the coin with a target on the wheel, the value of the target is looked up and a win is recorded. Controller 177 then instructs the ticket dispenser 181 to distribute an award that corresponds with the values of the win. As explained above, coin detector 140 includes a light source and a photodetector. A win is detected causing a payoff to occur if a pulse generated by a coin interrupting the infrared beam from the source to the photodetector coincides with a target location on the wheel. Output signals generated by the coin detector 117 are applied to CPU 177 which has the task of determining that a pulse from the coin detector 117 is received at a time corresponding to a payoff position. The CPU maintains a register of payoff values at addresses indexed by the different wheel position counts. When a hit is detected, the CPU 117 reads out the value from the register corresponding to the current wheel position maintained by the CPU and then uses this value to control the number of tickets dispensed by the ticket dispenser 181. The wheel home position sensor 179 is provided to ensure that the stepper motors accurately track the location of the wheel.

As described above, the operation of the device is controlled by a CPU unit 177 which has a multi-task operating system, so that the CPU can in effect perform several different tasks simultaneously. These tasks include a coin drop detection task which responds to a coin switch being closed in response to a coin being inserted into slot 101. In addition to the above tasks, which are performed on a time-shared basis, essentially simultaneously, the CPU also provides a wheel control function which keeps track of the position of the wheel by counting the steps of the motor. Likewise when the home position detector 179 detects that the home position has passed the detector, the CPU in response to receiving this signal from the detector 179 will interrupt the task being performed and reset the wheel position counter to zero.

In the preferred embodiment, the stepper motor drives a timing belt which turns the play field wheel. The drive ratio is reduced to 4:1. The stepper motor selected has 0.09 degrees per step or 400 steps per revolution. The motor can be driven at half step increments which brings the resolution to 0.45 degrees per step or 800 steps per revolution. When the drive ratio of play field wheel 109 is reduced by four, the resolution wheel is 0.1125 degrees and the number of steps per play field revolution is 3200. This high degree of resolution enables the CPU to precisely tract the location of the play field and payoff position on the wheel and to correlate them with the signal from coin detector 117. The position of the targets correspond to known ranges of the motor steps.

In addition to the coin sensor, an optical sensor is also used to detect the home position of the wheel 109. In this operation, a flag or impediment extends down from the lower surface of the wheel and is positioned to interrupt a beam from the light source to an opposite photodetector. This interruption occurs once per revolution of the wheel and the signal serves to restart the motor step count by the CPU 117.

The coin sensor is activated by the coin and since the home position sensor tells the CPU exactly where the scoring targets are with respect to the motor step count, and will provide a signal that corresponds exactly with the coin relative to the motor step count, the CPU can determine the location of the coin relative to the motor step count and thus determine if the location corresponds to a target position. If the coin corresponds to a target position, the CPU looks up the value of the target position and instructs the ticket dispenser to dispense the appropriate number of tickets.

While in the preferred embodiment of the invention, controller 177 accurately tracks the location of the wheel

109 using stepper motors, alternative manners in which to detect and correlate the location of a wheel and that of a coin are well known and include mechanical as well as electronic means and optical-electronic means. For example, the coin may be detected after it has been removed by the coin knock-off arm and the location of the con on the wheel may be determined because the time that elapses from the removal of the coin from the wheel to the coin detector can be made repeatable and predictable. In such an alternative embodiment, a coin falling into the coin receptacle can be detected by the interruption of a curtain of light. A signal from the light curtain may be sent to the CPU and then correlated with the wheel location. If the controller correlated the location of the coin with a target location, an award would be provided. While this manner of scoring would be feasible, it is desirable to detect winning coins and award the player shortly after the player has won in order to maintain the interest of the player.

In a first embodiment the target array is arranged at angular positions on the wheel and the array consists of multiple targets. While a grand prize is surrounded by areas that have no award, other areas may have targets having values that progressively decrease on adjacent sides. Thus a player may be progressively awarded a higher payoff if he or she can time the insertion of the coin so that it comes to rest near or on the target area. Because the speed of the coin as it travels down the coin track, chute, wheel and coin guide is relatively constant, a player can use his or her skill to time the insertion of the coin to try to have the coin released from the coin guide to result in the coin resting directly over a target region. Accordingly, in this first embodiment, the play of the game is dependent on the skill on the operator. The award may be in the form of tickets that can be redeemed for prizes or the device can be programmed to dispense a predetermined number of coins that correspond to the level of award.

In a contemplated alternative embodiment of the invention, the game is adapted for use with debit cards. In this contemplated embodiment, in response to the detection of sufficient credit on a magnetic strip on a debit card, a player is provided with a predetermined number of credits to play the game. Credits may be used by a player by the activation of a credit button. In response to activation of the credit button, a coin mechanism will release a coin or token internal to the game from the coin mechanism using a release button. Coins may be continuously replenished to the coin mechanism using a conveyor and hopper system that obtains coins from the coin receptacle.

Figure 5:
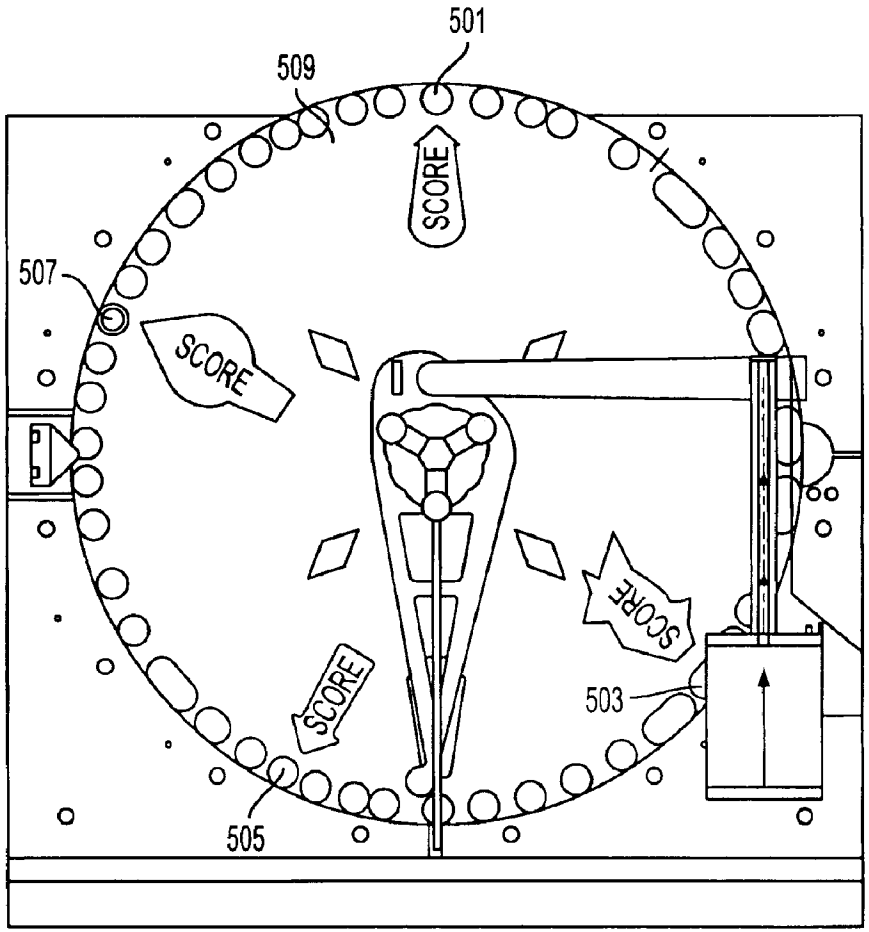
FIG. 5 is a top view of a second embodiment of the invention where the game is configured in a random award arrangement.

Now referring to FIG. 5, in a second embodiment of the invention, the game is altered from the skill game as described above to a game where the award is provided to players entirely at random or by chance. One manner in which to alter the game so that it is no longer dependent on skill is to provide small targets at entirely random locations at angular positions on the wheel. For example, in FIG. 5, an embodiment having a total of four win positions 501, 503. 505 and 507 on the wheel 509 is depicted. Another manner in which to make the award of a prize a random event is to increase the speed of the wheel so that a player cannot reasonably predict the timing of the release of a coin to coincide with the coin coming to rest at a particular target position. Yet a further manner is to prevent a player from providing a regulator on the coin mechanism that interferes with a player's ability to time the release of the coin from the coin mechanism. In the forgoing embodiments, the award of prizes to players is essentially governed by chance rather than the exercise of skill. In a specific contemplated embodiment of the version of the invention that is dependent on chance, the targets may be arranged in a similar array as a roulette wheel. The detection step in the embodiment wherein the award of a prize is a random event is the same as that described above.

Figure 6:
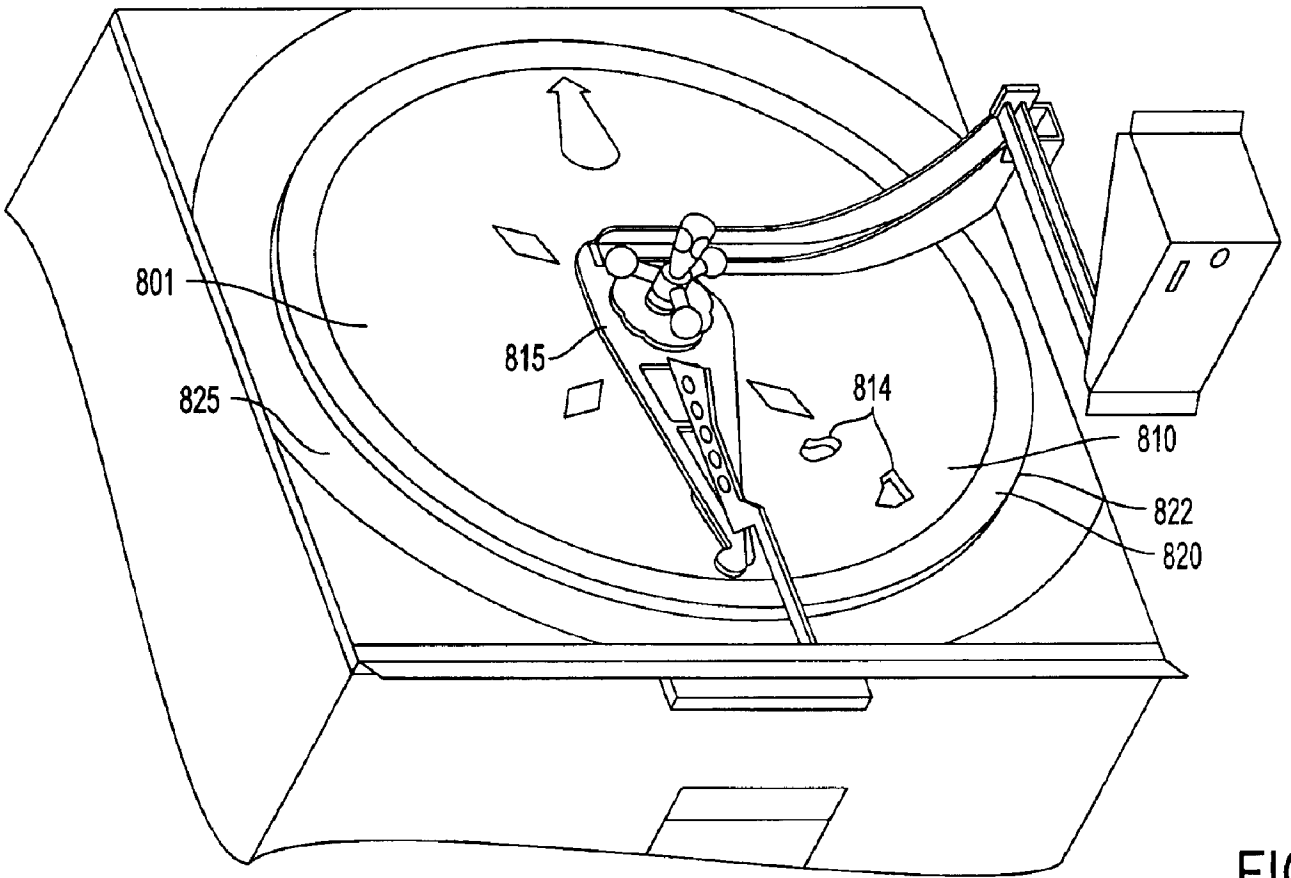
FIG. 6 is a perspective view of a third embodiment of the invention where the game is configured in a pusher game arrangement.

In yet a further contemplated alternative embodiment, the target wheel employs openings or transverse holes though the wheel that are positioned at angular locations around the wheel 801. Referring now to FIG. 6, coins that are on the coin guide 815 as through holes 814 pass underneath will fall through the holes into a coin receptacle. If the introduction of the coin is timed to coincide with the location of an opening, the coin will fall into the opening. Coins that fall through the opening can be detected using a light curtain or by mechanical means and directed to the coin receptacle. The action of a coin to falling through an opening can be programmed to either be advantageous targets for a player or be disadvantageous impediments to a player. Thus a player may attempt to time the insertion of the coin so that it will fall into an opening in the wheel or time the insertion of the coin so that is will avoid the opening in the wheel. The openings in the wheel may be of any shape and in any location and provide additional interest to the game. In yet a further contemplated embodiment, the edge of the wheel is not round but may have different dimensions such as in a saw-tooth arrangement, a square wave arrangement or other random arrangement.

In many of the embodiments, coins that do not pass through a target opening are removed from the turntable wheel by a knockoff arm 119 and are detected as they fall into a coin collector. When the player records a win, he is awarded with tickets or, alternatively, he may be awarded to coins or tokens.

Alternative manners in which to detect the location of payoff positions or wheel locations are well known in the art. For example, the rear of the wheel can be provided with light reflecting segments and dark segments that are distributed around the wheel. The position of these segments can correspond to the targets on the front face of the wheel. An optical sensor including an infrared light source directs light on the rear of the wheel and light is reflected back to a photodetector. The photodetector reads the light and dark segments and generates a square wave signal in response. The negative going transitions of the wave form correspond to the leading side of the segments as they cross into the infrared beam generated by a wheel position detector. This signal may be transmitted to a controller where it can be correlated with the signal from a coin detector. The CPU can maintain a wheel position count and increments the wheel position count in response to each positive transition of the waveform from the detector. Mechanical sensors may also be used in connection with the invention.

Although the preferred embodiment of the game uses a coin track and coin chute, it is further contemplated that other paths could also be advantageously used in the invention to introduce a coin on its side to the wheel. For example, a coin chute could be provided without a coin track that allows a player to directly slide a coin on the wheel from a coin acceptor. Other features could be provided that would enable a player to alter the location of the introduction of the coin to the wheel. For example, the coin chute could be provided on a pivot that would provide a player to exercise additional control over the introduction of the coin to the wheel.

Now again referring to FIG. 6, an alternative embodiment of the invention is shown where the game is configured in a pusher arrangement. In this embodiment, the coin is introduced to wheel 801 in the same manner as described above. Wheel 801 which is devoid of any target regions, also rotates at constant speed like the first embodiment of the invention and preferably at about 18 r.p.m. In this pusher embodiment, the coin guide 815 extends to the edge of a first interior region 810 of rotating wheel 801. As a result, in the pusher embodiment the coin guide pushes the coins out of region 810 to second annular region 820. As the coins are pushed into this second region, they contact coins that are resting in the annular region and cause adjacent coins to be pushed toward and over the edge of ledge 822. Coins falling off the ledge fall into region 825 where the coins are either counted and a corresponding number of tickets are distributed to the player or a portion of the fallen coins are returned directly to the player. The object of this embodiment is to time the insertion of the coin so that it will be released from the guide 815 at an area where there is high likelihood that it will engage coins that are next to the edge and cause them to fall off. As the coin leaves the coin guide, the coin will come into contact with other coins that may be positioned around the periphery of the wheel on ledge 820. In this embodiment, the player attempts to time the insertion of the coin so that it leaves the coin guide to cause it to contact other coins to cause coins resting on the edge of the ledge to fall off. A conventional tilt mechanism is provided that prevents tampering with the machine.

Figure 7:
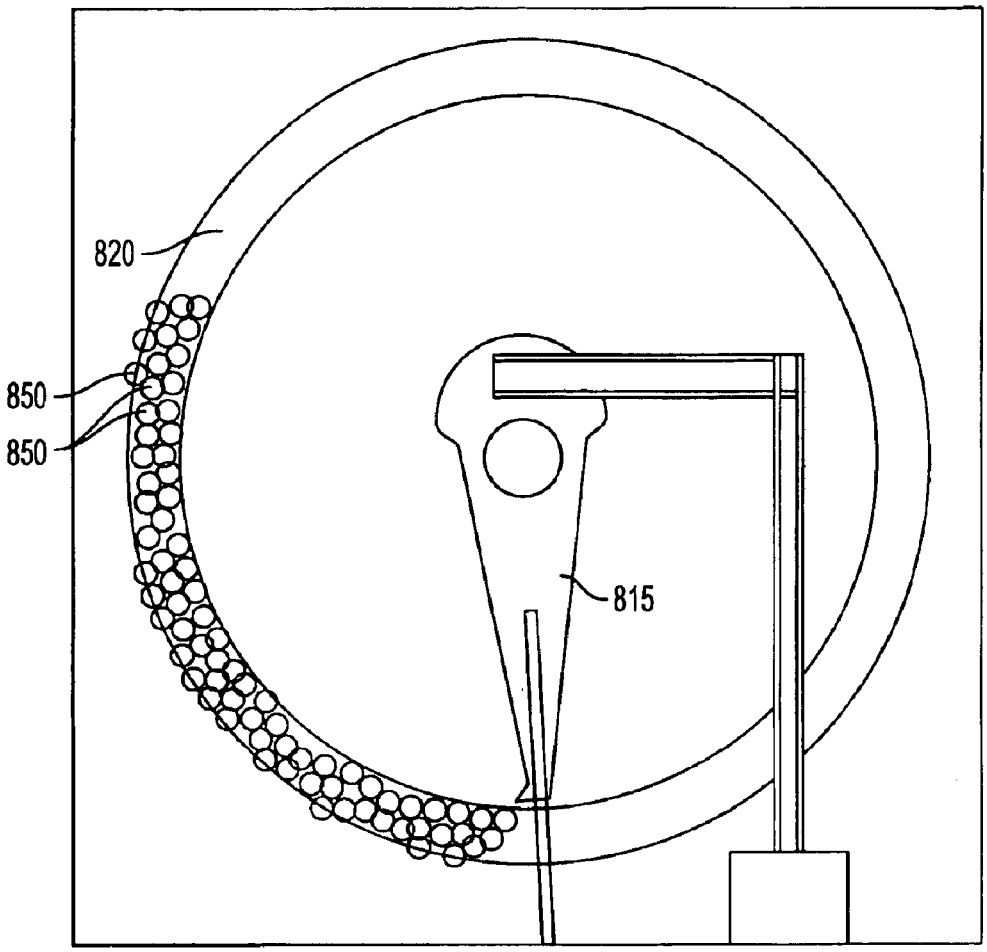
FIG. 7 is a top view of a third embodiment of the invention.
Figure 8:
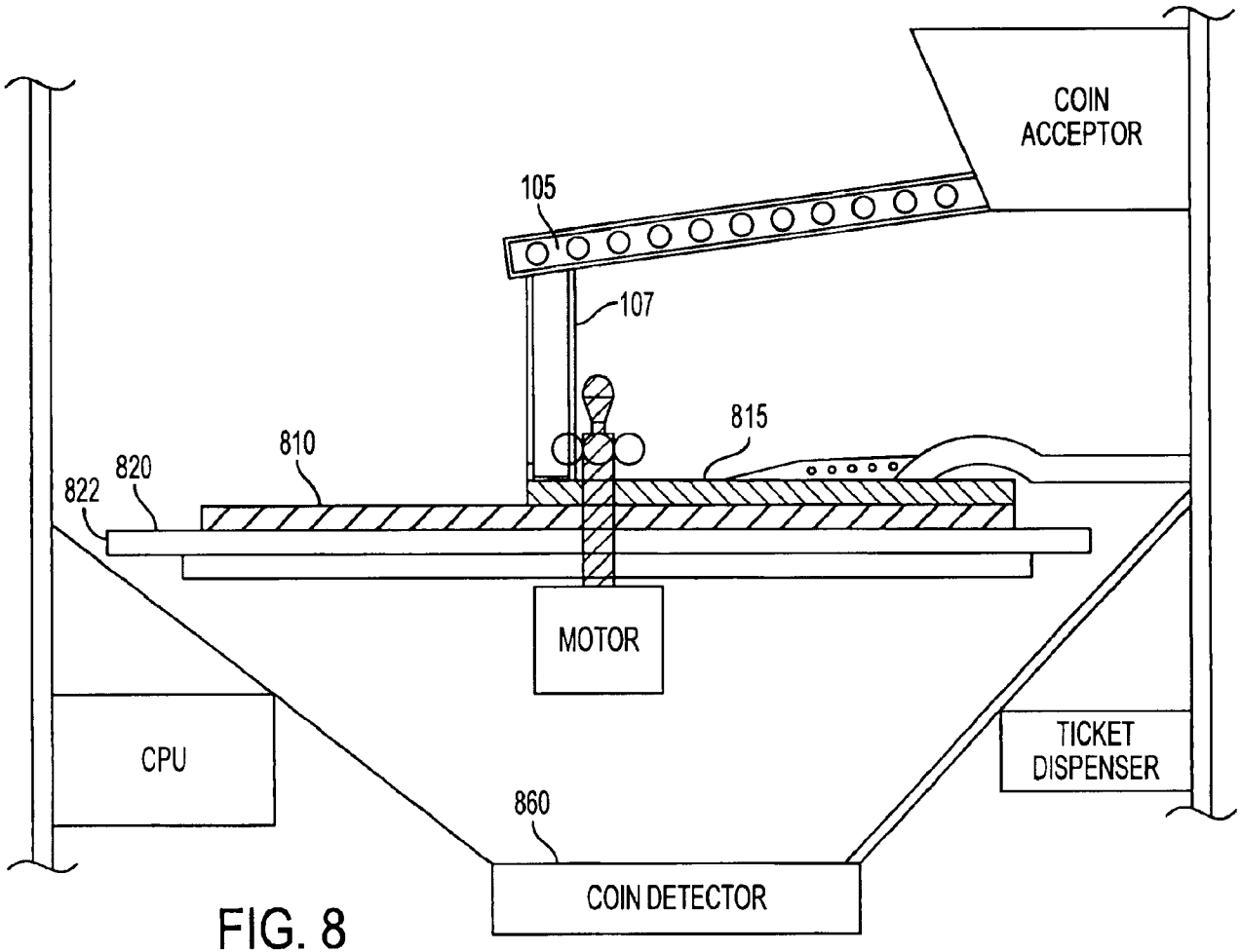
FIG. 8 is a side view of a third embodiment of the invention.

Coins that fall from the ledge can be either returned to the player or the number of coins that fall are counted and a corresponding number is ticketed and dispensed from the dispenser. As seen in FIG. 7, the coins 850 are depicted in region 820. Coins located in region 820 have been released from guide 815. Additional coins that are released from guide 815 engage those coins resting in region 820 and push them towards ledge 822. FIG. 8 shows a side view of the pusher embodiment wherein the annular region 820 is lower than region 810. This arrangement allows for a number of coins to build up on to one another in the region. Also shown in FIG. 8 is the manner that coins can drop off the ledge 822 and be directed to a coin detector 860.

In yet further contemplated embodiment, the wheel operation either serves as a secondary event in connection with a different game sequence or, the wheel sequence is followed by a secondary event. The term secondary event is generally used to describe a second separate operation that is initiated upon input from a first or primary event. The use of secondary events allows for the odds to be increased. For example, in a contemplated embodiment, the wheel sequence is initiated after a primary event that consists of the activation of a conventional slot machine. In this embodiment a coin or token is inserted into a slot machine. In the event that the player is awarded from the slot play, the coin is then directed to the coin track or coin chute as described above. For example, a slot machine may be programmed to hold a coin in escrow and randomly introduce the coin to the wheel. In the event that the coin comes to rest at a target location, the payoff for the slot machine can be increased.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

We claim:

1. An amusement game comprising a horizontally-oriented rotating wheel, means to introduce a coin to a central region of said rotating wheel, guide means to direct said coin in a radial direction from said central region of said wheel toward the periphery of said wheel, a plurality of payoff positions located at angular positions on said wheel, and means to determine if a coin introduced to said wheel intersects with said payoff position.

2. The amusement game recited in claim 1 wherein said means to introduce said coin onto said wheel is controlled by a player and the travel of the coin is predictable and repeatable.

3. The amusement game as recited in claim 1 wherein said means to introduce said coin to said wheel comprises a coin track that allows the coin to roll on its circumferential edge.

4. The amusement game as recited in claim 1 wherein said means to introduce said coin to said wheel comprises a coin chute that allows said coin to slide on a lateral side.

5. The amusement game as recited in claim 1 wherein said wheel is rotated at a constant rate.

6. The amusement game as recited in claim 1 wherein said means to determine if said coins intersect with said payoff positions comprises a stepper motor controlled by a Central Processing Unit and a coin detector, said coin detector further comprising a light source and a photodetector, wherein if a coin that intersects with said payoff position interrupts said light beam, said photodetector sends a signal to said Central Processing Unit and said unit correlates said signal with information relating to the position of said payoff positions on said wheel and determines if the signal is received at a time corresponding with a payoff position.

7. The amusement game as recited in claim 6 wherein said coin guide directs said coin to said periphery and releases said coin so that a portion of said coin overhangs the edge of said wheel and said coin detector is positioned to detect that potion of said coin that overhangs said wheel.

8. The amusement game as recited in claim 1 wherein said means to introduce said coins comprises a debit card reader for the detection of a predetermined credit value on a debit card, and a release button for the release of coins from a coin cache internal to the game.

9. The amusement game as recited in claim 8 wherein a player can time to release said coins so that they will be introduced to said wheel at a predictable time.

10. The amusement game recited in claim 8 further comprising a ticket dispenser wherein a player that successfully plays the games so that a coin intersects with a payoff position will be distributed a number of tickets that correspond with the value of said payoff position.

11. A corn operated amusement device as recited in claim 10 further comprising means to dispense a payoff corresponding to the value determined by said value determining means.

12. A coin operated amusement device as recited in claim 11 wherein said dispensing means dispenses said payoff in the form of tickets.

13. The amusement game of claim 1 wherein the release of coins from a coin release mechanism is random so that the chances of having a coin land on a payoff position is also a random event.

14. The amusement game as recited in claim 1 wherein the location that the coin is released from the coin guide is not predictable.

15. The amusement game as recited in claim 1 wherein the timing of the introduction of the coin to the game is a random event and accordingly, a player cannot exercise skill to try to cause a coin to intersect with a payoff position.

16. An amusement game comprising a coin acceptor for the reception and analysis of coin from a player and for directing genuine coins to a coin track, said coin track inclined on an angle and allowing said genuine coin to roll down said coin track to a coin chute, said coin chute for directing a genuine coin from said coin track to a rotating play field, said coin chute oriented to allow said coin to slide on a lateral side, motor means to constantly rotate said play field around a central axis, said play field being horizontally-oriented, a coin guide positioned above said play field and extending from said central axis toward a peripheral edge of said play field, said coin guide adapted to engage the circumferential endwall of said coin that has been introduced to said play field and direct said coin towards said periphery of said play field, a plurality of payoff positions located on said play field and means to determine if said coin intersects with one of said payoff positions.

17. The amusement game as recited in claim 16, wherein said coin guide is positioned to release said coin at a location on the edge of said play field to cause a portion of said coin to extend over the edge of said play field and said coin detector detects the portion of said coin that extends of the edge.

18. The amusement game as recited in claim 16 further comprising through holes positioned on said play field and coins that fall through said holes that do not reach the periphery of said wheel.

19. The amusement game as recited in claim 16 wherein said payoff positions comprise through holes through said play field and coins that fall through said through holes are detected by a coin detector.

20. The amusement game as recited in claim 16 further comprising an outer annular area on said play field that allows coins to rest on the rotating area and said coin guide directs and releases coins from said inner region on said play field to said outer annular area and coins released from said coin guide may engage additional coins resting in said annular area causing said additional coins resting in said area to be pushed outwardly.

21. The amusement game recited in claim 20 wherein said annular area has a floor that is lower than the surface of an area of said play field that passes underneath the coin guide and thereby said annular region will accommodate a number of layers of coins in this region.

22. The amusement game as recited in claim 16 wherein said payoff positions are located at random locations around said play field.

23. A method of playing an amusement game comprising timing the insertion of a coin into the game to cause it to come to rest on a rotating wheel, said rotating wheel having a stationary coin guide that moves said coins toward payoff positions located on the periphery of said wheel.

24. A coin operated amusement device comprising means defining a coin track to guide a coin in a predetermined path and introduce said coin on its side to a horizontally-oriented rotating play field, a stationary coin guide for the engagement of a circumferential endwall of said coin and direct said coin from a center region of the wheel to the edge of said wheel, at least one payoff position at an angular position on said wheel, and a coin detector to detect the presence of a coin and a wheel position detector to determine the location of the wheel and a controller to correlate the position of the coin with the position of payoff positions on said wheel.

25. A coin operated amusement device as recited in claim 24 wherein said wheel defines a plurality of payoff positions distributed around said wheel.

26. A coin operated amusement device as recited in claim 25 wherein said payoff positions have different values and wherein said controller determines the value of the payoff position intersected by a coin.

* * * * *